United States Patent [19]

Neuhof

[11] 4,016,376

[45] Apr. 5, 1977

[54] CONCAVE DIAPHRAGM FOR ELECTRO-ACOUSTIC TRANSDUCER

[75] Inventor: Jacob Neuhof, Bridgeport, Conn.

[73] Assignee: General Signal Corporation, Stamford, Conn.

[22] Filed: Jan. 8, 1976

[21] Appl. No.: 647,633

Related U.S. Application Data

[63] Continuation of Ser. No. 538,999, Jan. 6, 1975, abandoned.

[52] U.S. Cl. ..... 179/115 R; 181/171; 340/391

[51] Int. Cl.[2] ..... H04R 7/22; H04R 13/00

[58] Field of Search ..... 179/114 R, 115 R, 181 R; 340/384 E, 397, 402, 388, 391; 181/171, 173

[56] References Cited

UNITED STATES PATENTS

| | | | |
|---|---|---|---|
| 496,224 | 4/1893 | Holman | 179/115 R |
| 751,501 | 2/1904 | Gundlach | 179/115 R |
| 1,087,127 | 2/1914 | Marr | 179/181 R |

FOREIGN PATENTS OR APPLICATIONS

| | | | |
|---|---|---|---|
| 1,598 | 1/1911 | United Kingdom | 179/181 R |

*Primary Examiner*—George G. Stellar
*Attorney, Agent, or Firm*—Milton E. Kleinman; John F. Ohlandt

[57] ABSTRACT

An electro-acoustic transducer, adapted to constitute part of an alarm unit, includes a magnetic diaphragm adjacent the core of the transducer. The case for the transducer is so configured that it forces the diaphragm into a concave shape, whereby the diaphragm operates extremely efficiently and provides other advantages over a planar diaphragm.

7 Claims, 4 Drawing Figures

CONCAVE DIAPHRAGM FOR ELECTRO-ACOUSTIC TRANSDUCER

BACKGROUND, OBJECTS AND SUMMARY OF THE INVENTION

The present invention relates to an electrically operated sound producing device and more particularly, to an electro-acoustic transducer especially adapted to be used in an alarm unit.

A wide variety of devices of the class to be described have been known in the prior art. Many of these devices have been specifically tailored to meet particular requirements of size, operating voltages, etc., and to meet certain costs and other manufacturing considerations.

In order to provide some background for the present invention, reference may be made to copending application Ser. No. 517,681, filed Oct. 24, 1974, now U.S. Pat. No. 3,931,549. The invention in that copending application relates to an electronic means for controlling an electro-acoustic transducer and for vibrating the diaphragm thereof at a frequency of the order of 2500 Hz. Although it is contemplated that the particular driving circuit described in the aforesaid copending application be used in conjunction with the present invention, the present invention is not necessarily limited to use only with such driving circuit.

Accordingly, it is a primary object of the present invention to improve significantly on the efficiency in the transfer of energy from electrical input to acoustical output for a class of devices designed to provide an alarm signal involving a substantially single frequency audio output.

It has been found that if the magnetic diaphragm utilized in the type of device under consideration is so supported as to be biased into a concave configuration, distinct advantages are obtained over a planar diaphragm. Thus, a better DB output is provided by the concave configuration since a lighter diaphragm can then be used and yet the concaveness will provide the frequency desired. Moreover, it has been found that a superior frequency response is obtained as will be made evident hereinafter. In addition, it has been found that the DB output for the concave configuration for the diaphragm is much more constant throughout the voltage range of operation. This advantage will also be made manifest as the description proceeds.

Further and other objects, advantages and features of the invention will be apparent from the following description of a preferred form of the invention as seen in the accompanying drawings.

DESCRIPTION OF PREFERRED EMBODIMENT

Referring now to the figures of the drawings, there is illustrated a detailed embodiment of the present invention. The invention relates particularly to the discovery that by having the diaphragm of an electro-acoustic transducer of the type to be described in a concave configuration, substantial improvement is effectuated in the acoustic signal output of such device and such device has improved frequency response.

Figure 4:
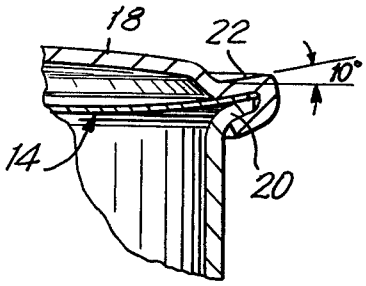
FIG. 4 is an enlarged fragmentary view of the rim of the lower housing, together with the rim of the cover, for the electro-acoustic unit.
Figure 2:
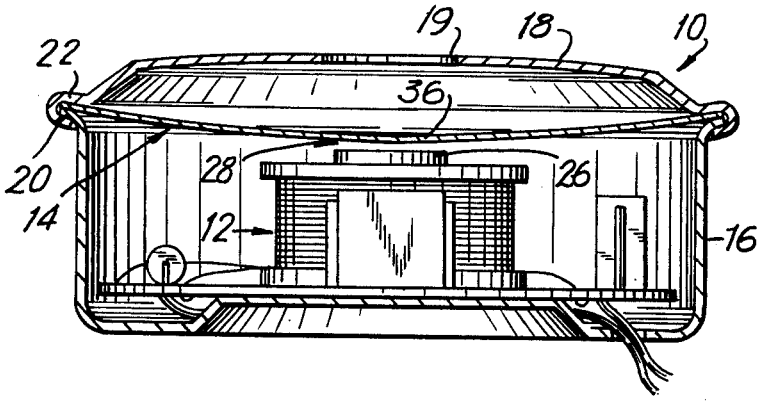
FIG. 2 is a sectional view, taken on the line 2—2, of the horn assembly seen in FIG. 1.

The electro-acoustic transducer 10 basically includes a driving means 12 driving a diaphragm 14 so as to produce an audible signal output. The casing for the transducer includes a cup-shaped lower housing 16 and a cover 18, the cover preferably having a sound-transmitting aperture 19 therein. The cover 18 has near its rim a bent or inclined portion 22 which, as will be especially seen in FIG. 4, is at an angle of approximately 10° to the horizontal. The lower housing 16 has a lip or flange 20 which is correspondingly inclined with respect to the horizontal at an angle of approximately ten degrees. Accordingly, it will be appreciated that the diaphragm 14, which is normally in planar form, is, as a consequence of being mounted and held at its periphery between the lip or flange 20 of lower housing 16 and bent portion 22 of the cover 18, forced into a concave configuration. Thus, the diaphragm 14 is biased so as to establish a concave configuration as the normal or neutral point for operation, without requiring that any restraining mechanical force be imposed upon the diaphragm, at or near its center, in order to produce such concave configuration. Consequently, the diaphragm is free to move in its entirety above said neutral point, and no magnetic energy need be supplied in driving the diaphragm to overcome that restraint imposed by such mechanical force. Therefore a substantial increase of efficiency is obtained.

Figure 3:
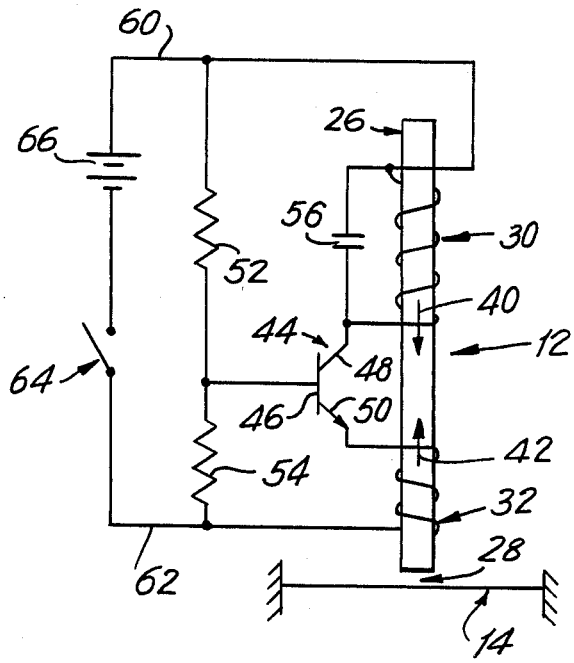
FIG. 3 is a schematic diagram of a typical driving circuit for controlling the operation of the electro-acoustic transducer.

It will be understood that the diaphragm 14 is intended to be excited into vibration in response to the buildup and decay of magnetic flux between a core 26, which is part of the driving means 12, and the diaphragm. The magnetic circuit involved includes the aforesaid core 26, the lower housing 16, the diaphragm 14 and the air gap 28. The magnetic flux is generated in response to an electric current in a coil which surrounds the core 26. In the embodiment illustrated, as particularly seen in FIG. 3, the coil of the transducer 10 includes two portions, an inner coil or primary winding 30 and an outer coil or secondary winding 32. The arrangement of these coils on the core 26 may vary in accordance with engineering and design considerations, the foremost consideration being the characteristic of the primary winding with respect to the secondary winding. In the particular circuit under consideration, as illustrated in FIG. 3, the primary winding 30 has a number of turns which are approximately five or six times the number of turns on the secondary winding 32. Further details of such a particular driving means may be appreciated by reference to copending application Ser. No. 517,681, now U.S. Pat. No. 3,931,549.

The interior dimensions of the casing of the transducer unit are such that after assembly there is a space 28 between the face of the core 26 and the depending central section of the concave configuration, that is, section 36. The assembly is so accomplished that the space is acceptable within tolerance limits or slightly too large. In the latter case, the space is later reduced by a means similar to that disclosed in copending application Ser. No. 431,802, filed Jan. 8, 1974.

Figure 1:
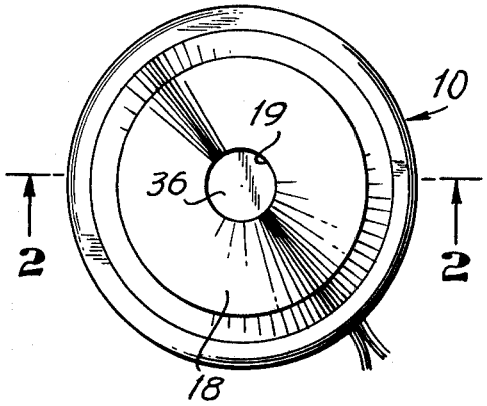
FIG. 1 is a plan view of a complete horn assembly or electro-acoustic unit as contemplated by the present invention.

Referring particularly to FIG. 3, the components in the schematic diagram which have already been identified in FIG. 1, are identified by the same numerals. There will be seen the primary winding 30 and the secondary winding 32 which are wound in an opposite sense; that is, if current flows through the coil or winding 30 from the top to the bottom thereof and generates a magnetic flux in a direction indicated by the arrow 40, then a current flowing in the secondary winding 32 from top to bottom will generate a magnetic flux indicated by the arrow 42 which is in opposition to the flux generated by primary coil 30. Thus, the magnetic fluxes generated by the two windings will oppose each other and the resultant magnetic force will be proportional to the difference between the two fluxes.

As will be seen as the description proceeds, the primary and secondary coils 30 and 32, respectively, are essentially in series, and therefore, will normally have the same current. However, since the primary winding 30 has significantly more turns that the secondary winding 32 and since the magnitude of the magnetic flux 40 and 42 is a function of the ampere turns of their respective coils, it will be seen that the primary winding 30 will generate a significantly greater magnetic flux 40 than that generated by the secondary winding 32. Accordingly, the resultant flux will be in the direction indicated by the arrow 40.

The circuit includes a transistor 44 having a base 46, a collector 48, and an emitter 50. The lower end of the winding 30, as viewed in FIG. 3, is coupled to the collector 48 of the transistor 44, and the upper end of the primary 30 is coupled to the base 46 through a resistor 52. The upper end of the secondary winding 32 is coupled to the emitter 50, while the lower end of the secondary winding 32 is coupled to the base 46 through resistor 54. A capacitor 56 is coupled across the primary winding 30. The resistor 52 has a resistance approximately ten times that of the resistor 54. Two leads, 60 and 62, and a switch 64 are provided for coupling the circuit of FIG. 3 to an external direct current source 66.

When switch 64 is closed, direct current will flow from the positive terminal of direct current potential source 66 through resistors 52 and 54 and back to the source. This will place the base 46 of the transistor 44 at a potential which is slightly positive relative to the negative potential of the source 66. The emitter 50 of the transistor 44 will be at the negative potential of the source 66 at time $t = 0$ (i.e., at the instant of closing the switch 64) and before any current has started to flow through the transistor 44. Since the transistor 44 is an NPN type, when the switch 64 is closed and the base 46 becomes positive with respect to the emitter, this corresponds to a condition for turning on the transistor 44 and initiating conduction between its collector and emitter. With the transistor 44 biased to conduction, current will attempt to flow from the positive terminal of source 66 by way of lead 60 through the parallel combination of capacitor 56 and primary coil 30 to the collector 48 of transistor 44 and to the emitter 50; thence through secondary winding 32 and back by way of lead 62 and switch 64 to the negative terminal of source 66. At time $t = 0 + \Delta t$ the inductance of the secondary winding 32 will inhibit the flow of current and relatively little current will flow. The inductance of the primary winding 30 will have the same effect but, in addition, the capacitor 56 shunts the primary winding 30 and the initial current is through capacitor 56. However, as soon as any current starts to flow through capacitor 56, it no longer serves as a zero impedance shunt and some current will also flow through primary winding 30. As time advances, the capacitor 56 will become fully charged and the current through the primary and secondary coils 30 and 32, respectively, will build up and there will be a resultant flux in the direction shown by arrow 40. As the current is increasing and the flux is changing, a potential will be induced in the secondary winding 32. As a consequence of the mentioned turns ratio of the two coils and the sense in which the two coils are connected, the voltage induced in coil 32 will be such as to place a positive potential at the upper terminal of coil 32. By an appropriate choice of the applied potential 66, base biasing as provided by resistors 52 and 54, together with a consideration of the characteristics of the primary and secondary windings 30 and 32, respectively, it will be possible to cause the induced voltage in secondary winding 32 to reverse bias the transistor 44 and terminate conduction thereof. With transistor 44 turned off, current will still circulate in the series circuit comprising primary winding 30 and capacitor 56 to dissipate the inductive energy stored in winding 30. However, due to the inherent resistance of the circuit, the current will decay and the magnetic flux will be reduced. The changing magnetic flux will continue to induce a voltage in the secondary winding 32. Eventually the current in the primary winding 30 will be greatly reduced, there will be very little magnetic flux, and the potential induced in the secondary winding 32 will be inadequate to hold the transistor 44 cut off. Accordingly, conduction through the transistor 44 will resume and the cycle described will be repeated.

The movement of the diaphragm 14 towards the core 26 and the concomitant reduction in the air gap 28 will tend to reduce the reluctance of the magnetic circuit and thereby provide an increase in flux density which will have an additional tendency to increase the potential induced in winding 32. The transistor 44 serves as a potential sensing means. That is, when the induced voltage across winding 32 rises sufficiently the transistor 44 will be biased to cut-off.

The diaphragm 14 is composed of springy magnetic material, preferably Blue Spring steel 0.0046 per ASTM, 682 steel grade 1095 Rockwell C48/51. The diaphragm has a natural frequency of vibration which is determined by its physical characteristics and by the mode of mounting. Similarly, the driving circuit has its own natural cyclical repetition rate depending on the magnitude of potential and the choice of transistor, resistor, capacitor and inductor values. In order to provide optimum performance, the electrical and acoustic vibration rates should be selected to be compatible.

In a similar manner to the electro-acoustic transducer disclosed in copending application Ser. No. 517,681, now Pat. No. 3,931,549, an electro-acoustic transducer constructed in accordance wit the principles of the present invention vibrated at a frequency of approximately 2500 Hz. However, because of the concave configuration provided by the particular mounting of the transducer of the present invention, a much higher sound output was obtained for a given electrical input than was the case with the transducer disclosed in the aforesaid copending application. Thus, utilizing the same 2N 3417 transistor; resistances of 120 Kilohms and 15 Kilohms for the respective resistors 52 and 54; primary winding 30 having approximately 1350 turns and secondary winding 32 approximately 250 turns; a DC potential in the range of approximately 60 to 30 volts and a capacitor 56 of approximately 0.040 MiFarads, a reasonably stable frequency was obtained in both cases. However, in the case of the diaphragm of the present invention a sound output of over 84 decibels was measured at a distance of one foot; whereas, for the transducer previously known and described in the aforesaid copending application the sound output was approximately 80 decibels.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. An electro-acoustic transducer, comprising a source of oscillatory current;

driving means connected to said source, including a magnetic core, and at least one winding around said core;

a diaphragm of magnetic material suspended so as to establish a concave configuration as the normal or neutral point for operation in response to said source of oscillatory current, the center of said diaphragm being adjacent one end of said core so as to define an air gap, said diaphragm being responsive to said driving means to produce an audible signal;

a casing for said transducer, said casing including a lower housing and a cover, and means on said lower housing and said cover for cooperatively mounting said diaphragm at its periphery, said means for cooperatively mounting said diaphragm including a flange, at the rim of said lower housing, inclined downwardly from the horizontal toward the center of the housing and at an angle of approximately 10°, and an inclined section in said cover which abuts the said flange and which is formed likewise at an angle of approximately 10° from the horizontal, thereby to hold the diaphragm between said flange and said inclined section in said cover so as to force the diaphragm into the aforesaid concave configuration, said diaphragm remaining in said concave configuration but being free to move in its entirety above said neutral point due to the lack of any restraining mechanical force imposed upon the diaphragm at or near its center.

2. A device as defined in claim 1, further comprising a magnetic circuit which includes said core, said diaphragm, said air gap and said lower housing of said casing.

3. A device as defined in claim 1, in which said driving means includes a transistor having base, collector and emitter electrodes;

a DC potential source;

first and second windings for producing magnetomotive forces in response to a flow of direct current from said DC source through said windings;

said first winding being in a circuit between one terminal of said DC source and said collector, said second winding being in the circuit between the other terminal of said DC source and said emitter; and biasing means at the input of said transistor for controlling its conduction.

4. The device as defined in claim 3, in which said first winding has substantially more turns than said second winding.

5. A device as defined in claim 4, in which said first and second windings are coupled in such sense as to generate opposing magnetomotive forces.

6. A device as defined in claim 5, in which said magnetomotive force generated by said first winding induces a potential in said second winding for terminating the conduction of said transistor.

7. A device as defined in claim 3, in which a capacitor is coupled across said first winding.

* * * * *